US010909844B2

(12) United States Patent
Dey et al.

(10) Patent No.: US 10,909,844 B2
(45) **Date of Patent: *Feb. 2, 2021**

(54) DYNAMIC ROAD WIDTH DIVISION FOR ADAPTIVE ROAD SPACE UTILIZATION

(71) Applicant: International Business Machines Corporation, Armonk, NY (US)

(72) Inventors: Kuntal Dey, New Delhi (IN); Rakesh Rameshrao Pimplikar, New Delhi (IN); Sudhanshu Shekhar Singh, New Delhi (IN); Biplav Srivastava, Yorktown Heights, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/547,991

(22) Filed: Aug. 22, 2019

(65) Prior Publication Data

US 2019/0378408 A1 Dec. 12, 2019

Related U.S. Application Data

(63) Continuation of application No. 15/442,845, filed on Feb. 27, 2017, now Pat. No. 10,607,481.

(51) Int. Cl.
*G08G 1/01* (2006.01)
*G08G 1/0967* (2006.01)

(52) U.S. Cl.
CPC ..... *G08G 1/0145* (2013.01); *G08G 1/096775* (2013.01)

(58) Field of Classification Search
None
See application file for complete search history.

(56) References Cited

U.S. PATENT DOCUMENTS 1,497,073 A 6/1924 Doyle
2,260,051 A * 10/1941 Pardee ..... E01F 15/006 404/12
3,958,890 A 5/1976 Ferrari
4,474,503 A * 10/1984 Booth ..... E01F 15/006 116/63 R (Continued)

FOREIGN PATENT DOCUMENTS

CN 104732775 A 6/2015

OTHER PUBLICATIONS

United States Notice of Allowance dated Aug. 7, 2019 in U.S. Appl. No. 15/442,845.

(Continued)

*Primary Examiner* — Emily C Terrell
(74) *Attorney, Agent, or Firm* — Anthony Curro, Esq.; McGinn IP Law Group, PLLC

(57) ABSTRACT

A computer-implemented dynamic road stretch dividing method, the method comprising: determining a current lane distribution of partitions of a road stretch; calculating a new lane distribution of the road stretch to ameliorate traffic based on a pragmatic factor; changing an alignment of the partitions of the current lane distribution to obtain the new lane distribution; and updating the pragmatic factor based on at least one of an external policy and a constraint input by a user.

9 Claims, 6 Drawing Sheets

(56) References Cited

U.S. PATENT DOCUMENTS

| | | | | |
|---|---|---|---|---|
| 4,632,598 | A | 12/1986 | Richards | |
| 4,690,583 | A | 9/1987 | Faulconer | |
| 5,470,171 | A | 11/1995 | Tseng | |
| 5,498,100 | A | 3/1996 | Guernsey | |
| 5,917,432 | A | 6/1999 | Rathbone | |
| 7,040,836 | B2 | 5/2006 | Rogers | |
| 7,329,067 | B1 | 2/2008 | Rodriguez | |
| 8,328,499 | B2 | 12/2012 | Mauro et al. | |
| 8,483,940 | B2 | 7/2013 | Chapman et al. | |
| 8,855,900 | B2 | 10/2014 | Lection | |
| 9,460,618 | B1 | 10/2016 | Soltesz et al. | |
| 9,734,710 | B2 | 8/2017 | Kang | |
| 2005/0270175 | A1* | 12/2005 | Peddie | G08G 1/096783 340/907 |
| 2007/0068078 | A1 | 3/2007 | Hosokawa | |
| 2007/0160420 | A1 | 7/2007 | Aoki | |
| 2009/0002195 | A1 | 1/2009 | Horvitz | |
| 2009/0034799 | A1 | 2/2009 | Nishida et al. | |
| 2009/0125160 | A1 | 5/2009 | Desai et al. | |
| 2011/0191011 | A1* | 8/2011 | McBride | H04W 28/06 701/117 |
| 2011/0221614 | A1 | 9/2011 | Al-Hasan | |
| 2015/0073687 | A1 | 3/2015 | Hampapur | |
| 2016/0091609 | A1* | 3/2016 | Ismail | G01S 19/49 702/150 |
| 2016/0125734 | A1 | 5/2016 | Stenneth | |
| 2017/0031359 | A1* | 2/2017 | Shashua | G08G 1/167 |
| 2017/0067216 | A1 | 3/2017 | Lee | |
| 2017/0213458 | A1 | 7/2017 | Gordon | |
| 2018/0357890 | A1 | 12/2018 | Fowe | |

OTHER PUBLICATIONS

United States Office Action dated Apr. 8, 2019, in U.S. Appl. No. 15/442,845.

United States Office Action dated Feb. 8, 2019, in U.S. Appl. No. 15/442,845.

United States Office Action dated Oct. 22 2018, in U.S. Appl. No. 15/442,845.

United States Office Action dated Aug. 10, 2018, in U.S. Appl. No. 15/442,845.

United States Office Action dated May 15, 2018, in U.S. Appl. No. 15/442,845.

United States Office Action dated Jan. 16, 2018, in U.S. Appl. No. 15/442,845.

Mel, et al. "The NIST Definition of Cloud Computing". Recommendations of the National Institute of Standards and Technology. Nov. 16, 2015.

"Method and Apparatus for Dynamically Dividing a Multi-Lane Road for Management of Vehicular Traffic". IP.com Prior Art Database, IPCOM000190266D, Publication Date: Nov. 23, 2009.

United States Notice of Allowance dated Nov. 29, 2019, in co-pending U.S. Appl. No. 15/445,845.

* cited by examiner

ROAD STRETCH DIVIDING METHOD 100

DYNAMIC ROAD WIDTH DIVISION FOR ADAPTIVE ROAD SPACE UTILIZATION

CROSS-REFERENCE TO RELATED APPLICATIONS

The present application is a Continuation Application of U.S. patent application Ser. No. 15/442,845, filed on Feb. 27, 2017, the entire contents of which are hereby incorporated by reference.

BACKGROUND

The present invention relates generally to a road stretch dividing method, and more particularly, but not by way of limitation, to a system, method, and computer program product for dynamically adapting a number of divided partitions on a given road and a number of (different) lanes for each partition.

Conventionally, road zippers and barrier transfer machines have been able to adjust the lanes on a road. For example, certain highways use road zippers to adjust the number of lanes in a particular direction based on past traffic patterns (i.e., more lanes during rush hour traffic out of a city).

However, the conventional techniques lack an intelligent or dynamic approach in the process of the decision on how many partitions to create on the road as well as lacking a dynamic way to ensure that across different stretches of varying road width that result from such dynamically decided-and-made partitions, the users have appropriate road symbols/signs in place for accurate driving.

SUMMARY

In an exemplary embodiment, the present invention can provide a computer-implemented road stretch dividing method, the method including determining a current lane distribution of partitions of a road stretch, calculating a new lane distribution of the road stretch to ameliorate traffic based on a pragmatic factor, and changing an alignment of the partitions of the current lane distribution to obtain the new lane distribution.

One or more other exemplary embodiments include a computer program product and a system.

Other details and embodiments of the invention will be described below, so that the present contribution to the art can be better appreciated. Nonetheless, the invention is not limited in its application to such details, phraseology, terminology, illustrations and/or arrangements set forth in the description or shown in the drawings. Rather, the invention is capable of embodiments in addition to those described and of being practiced and carried out in various ways and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

Aspects of the invention will be better understood from the following detailed description of the exemplary embodiments of the invention with reference to the drawings, in which.

DETAILED DESCRIPTION

Figure 1:
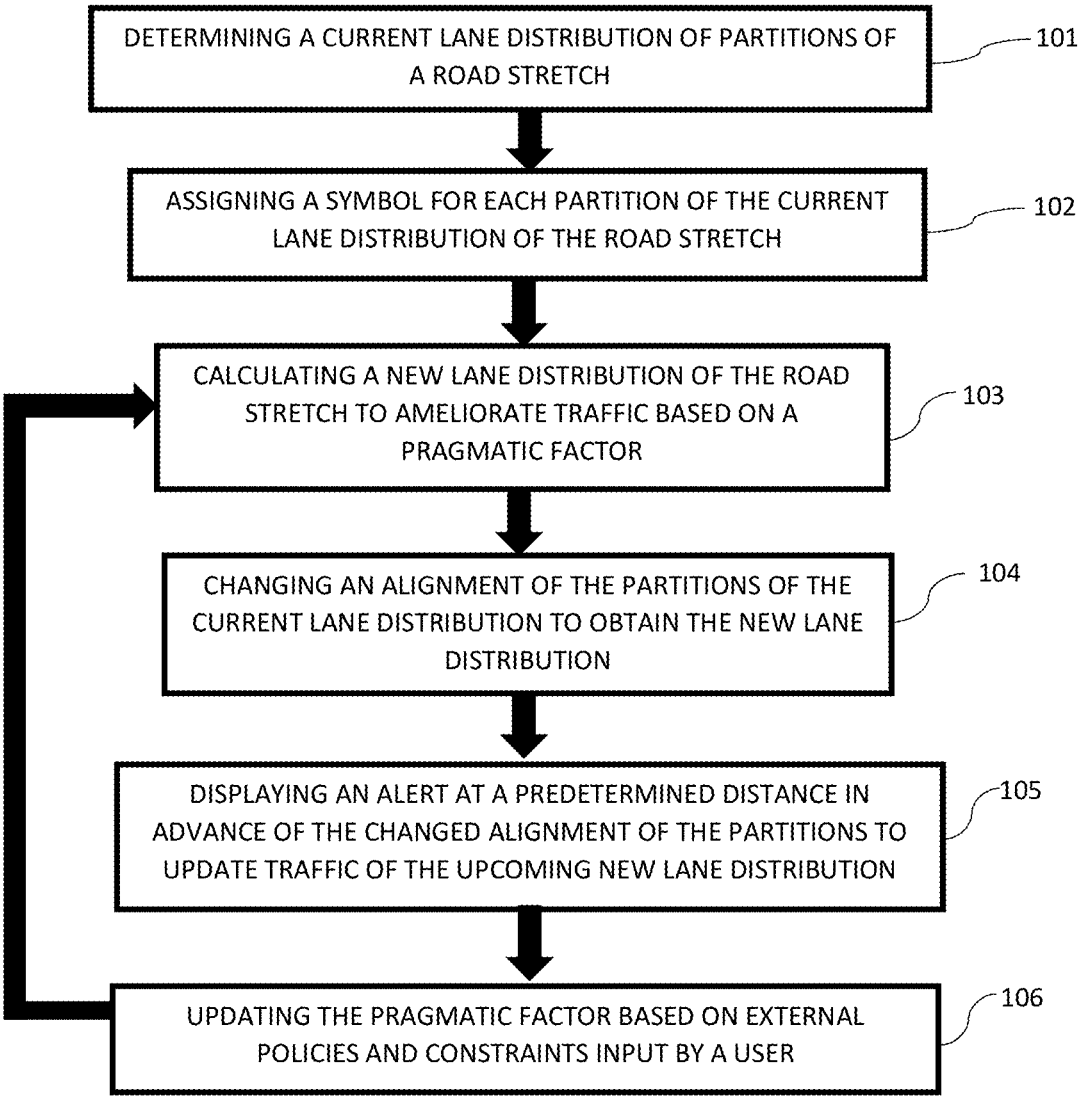
FIG. 1 exemplarily shows a high-level flow chart for a road stretch dividing method 100 according to an embodiment of the present invention.

The invention will now be described with reference to FIGS. 1-5, in which like reference numerals refer to like parts throughout. It is emphasized that, according to common practice, the various features of the drawing are not necessarily to scale. On the contrary, the dimensions of the various features can be arbitrarily expanded or reduced for clarity.

By way of introduction of the example depicted in FIG. 1, an embodiment of a road stretch dividing method 100 according to the present invention can include various steps for dynamically adapting the number of divided partitions on a given road stretch and the number of (different) lanes for each partition, as well as, for different road stretches having a different number of lanes and a different lane topology, create dynamically-managed electronic road signs/symbols/visuals/speech for users to use the road (drive, walk, etc.) effectively and in a risk-free manner. The method 100 can increase efficient usage of road space (e.g., a supply-side resource in traffic), reduces travel time during congestion, reduces pollution and fuel waste, and increases commuter satisfaction.

Figure 3:
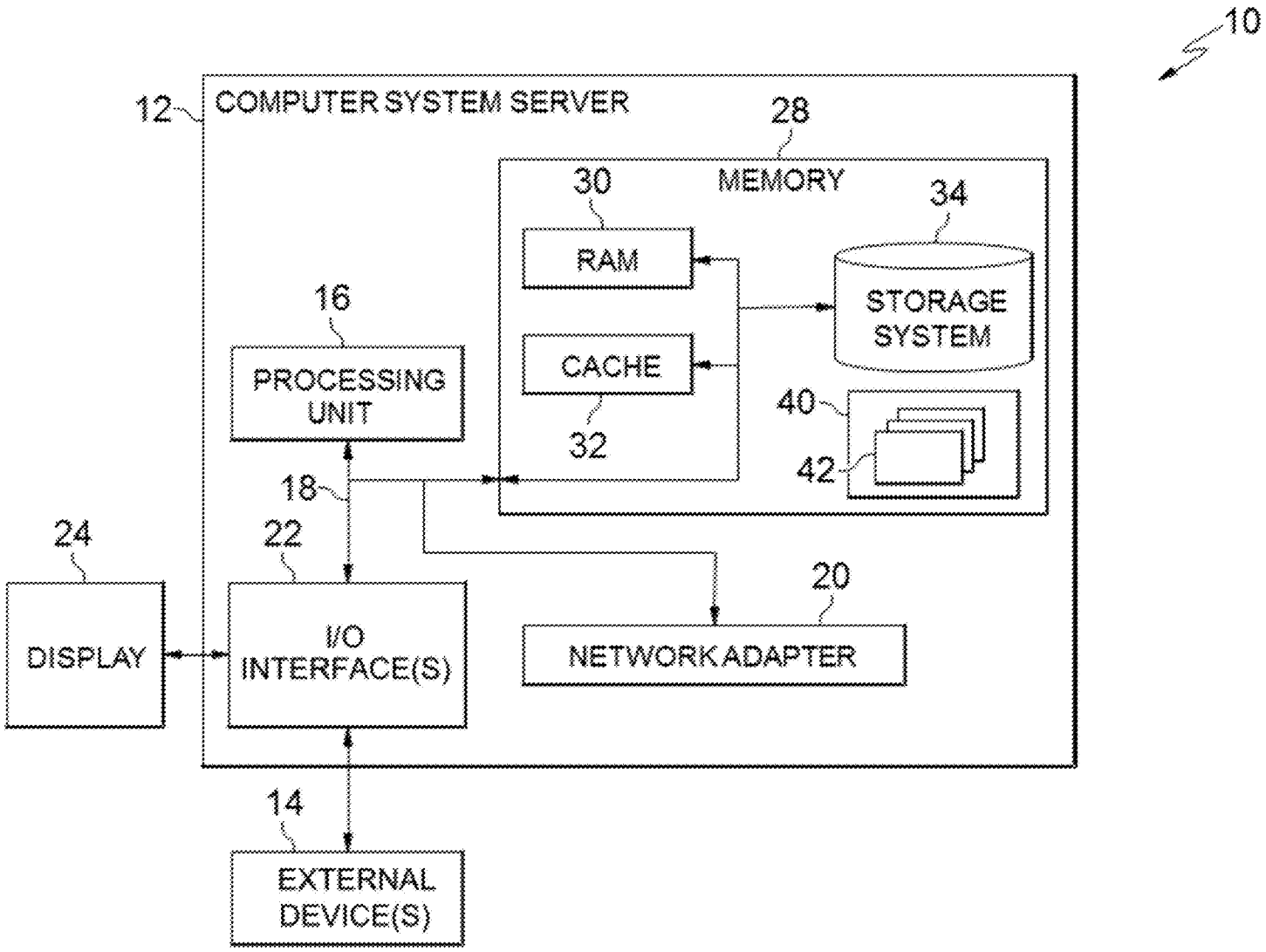
FIG. 3 depicts a cloud-computing node 10 according to an embodiment of the present invention.

By way of introduction of the example depicted in FIG. 3, one or more computers of a computer system 12 according to an embodiment of the present invention can include a memory 28 having instructions stored in a storage system to perform the steps of FIG. 1.

Thus, a road stretch dividing method 100 according to an embodiment of the present invention may act in a more sophisticated, useful and cognitive manner, giving the impression of cognitive mental abilities and processes related to knowledge, attention, memory, judgment and evaluation, reasoning, and advanced computation. In other words, a "cognitive" system can be said to be one that possesses macro-scale properties—perception, goal-oriented behavior, learning/memory and actions generally recognized as cognitive.

Although one or more embodiments may be implemented in a cloud environment 50 (see e.g., FIG. 4), it is nonetheless understood that the present invention can be implemented outside of the cloud environment.

In step 101, a current lane distribution of partitions of a road stretch is determined. For example, a number of lanes, which direction traffic travels, where the lanes are partitions (i.e., lane divider markers), width of the lanes, etc. can be determined.

It is noted that lane dividers 203 include a member that separates traffic on the road stretch into "partitions" (i.e., segments of the road including the lanes). The lane dividers can include a so-called "Jersey barrier", "Jersey wall", a moveable object partitioning the lanes, etc. that are barriers employed to separate lanes of traffic. The lane distribution refers to the amount of lanes within a partition.

Figure 2A:
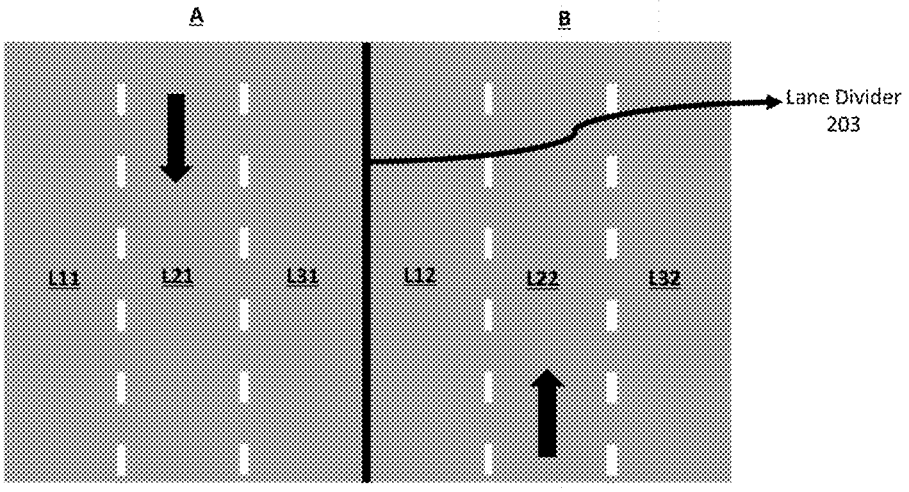
FIGS. 2A-2D exemplarily depict a current lane distribution and a new lane distribution in a lane stretch.
Figure 2B:
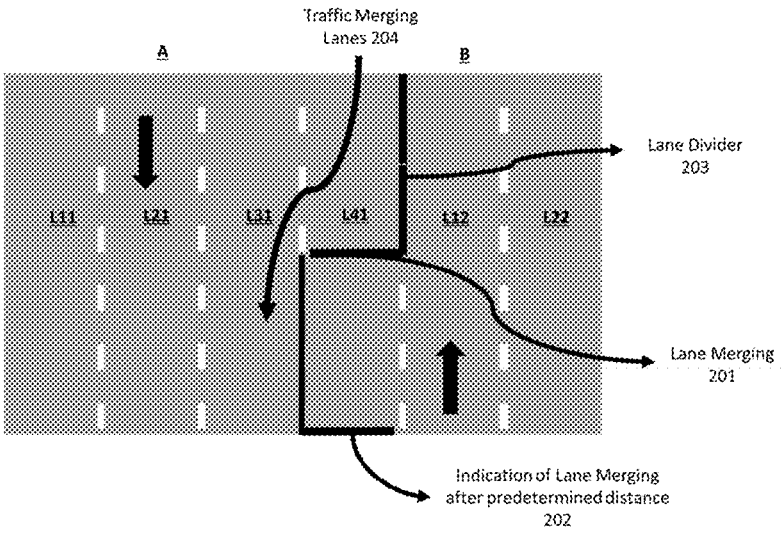

In step 102, a symbol is assigned for each partition of the current lane distribution of the road stretch. That is, for a road stretch S1, with P1 number of partitions, where the lane distribution of the partitions is L1D, L2D, . . . , LND, and LD1, LD2, . . . , LND. For example, as shown in FIG. 2A, the lane divider 203 (i.e., partition) partitions the road stretch into two partitions (A, B). The current lane distribution of the partitions (A, B) is L11, L21, L31 indicated that in partition A, lanes 1, 2, and 3 are all available for travel in a same direction (i.e., indicating by the downward arrow). That is, "D" in the annotation refers to a direction and lanes having the same number as the "D" indicate lanes for travel in the same direction. Also, the current lane distribution in the partition B is L12, L22, and L32 (i.e., three lanes (1, 2, 3) each for travel in the second direction (2)). The symbols on the roads can be assigned such that wherever there are settings with a changing number of lanes (such as, at the junction of two road stretches, if |A|!=|B|), the symbols show the upcoming partition topology.

In step 103, a new lane distribution of the road stretch is calculated to ameliorate traffic based on a pragmatic factor. The pragmatic factor can include, for example, a day, a time of the day, a day of the month, a current traffic condition, an expected traffic condition based upon historical profiles as well as based upon "today's observations", emergency vehicle data (i.e., emergency vehicles approaching and the partitions should be shifted), High-Occupancy-Vehicle (HOV) lanes, accidents, school zones, etc. That is, the pragmatic factor includes variables that indicate a change in traffic conditions (i.e., a negative change) on a road stretch such that a change in the lane distribution by moving partitions can ameliorate the traffic conditions. Also, the width of the lanes can be changed to, for example, allow for higher speed traffic during particular times of day. Or, the pragmatic factor can be entirely human-controlled and a human input can control the layout of the partitions.

Figure 2C:
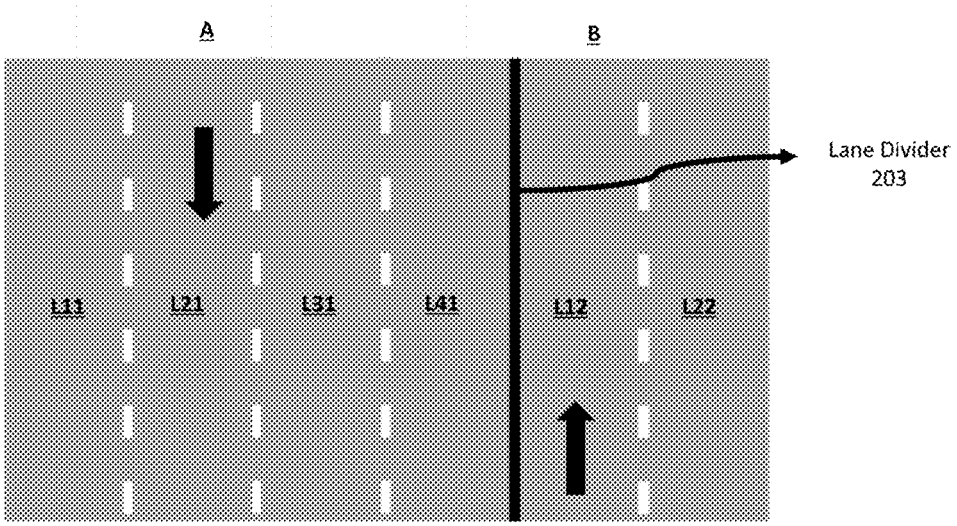

In step 104, the alignment of the partitions in the current lane distribution is changed in order to obtain the new lane distribution. FIG. 2C exemplarily depicts that the alignment of lane divider 203 (partition) is changed from FIG. 2A such that partition A now includes four lanes (L11, L21, L31, L41) and partition B includes two lanes (L12, L22). For example, partition A can be for traffic leaving a city during rush hour (i.e., the pragmatic factor is traffic congestion at a time of day) and changing the alignment of the partition to allow for four lanes leaving the city and only two entering the city results in less traffic.

Figure 2D:
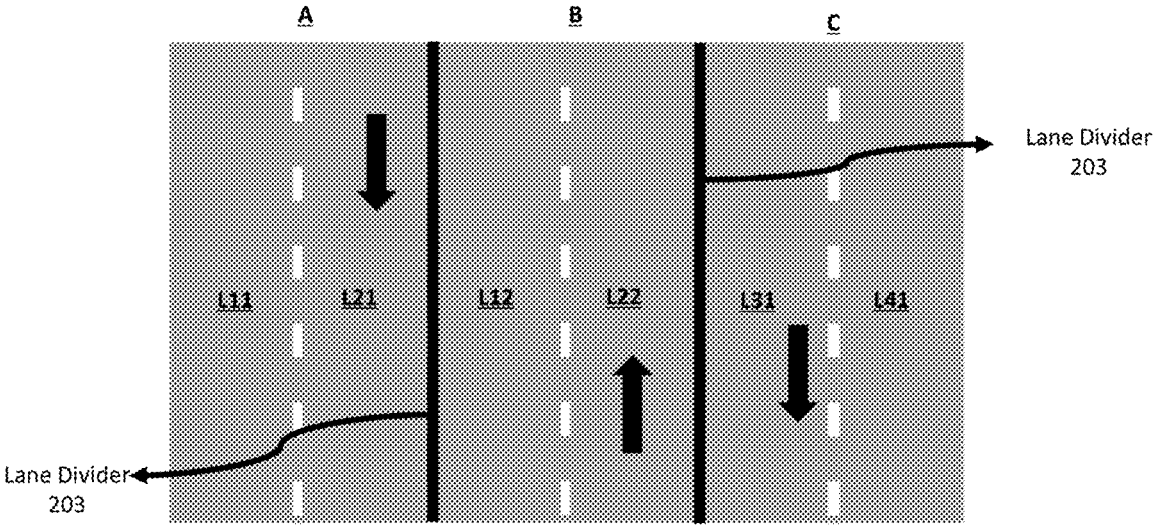

Referring now to FIG. 2D, FIG. 2D exemplarily depicts another exemplary lane distribution after step 104 changes the partition. The pragmatic factor can include a special event that requires only one in-bound lane with no exits and the exiting traffic to be able to have four lanes but an exit on both sides of the road stretch. Or, the pragmatic factor can include a local and an express route through a city such that only one partition has access to local exits while the other partitions are express routes through the city (i.e., similar to interstate 95 in New York City). Thus, the road stretch is split into three partitions (A, B, and C) using two lane dividers 203. Each partition A, B, and C includes two lanes but partitions A and C include lanes for the same direction of traffic (i.e., L11, L21, L31, and L41). Partition B includes two lanes L12, and L22.

In step 105, an alert can be displayed at a predetermined distance in advance of the changed alignment of the partitions to update traffic of the upcoming new lane distribution. For example, FIG. 2B exemplarily depicts the lanes merging 201 while the alignment of the partitions are being changed. At the horizontal partitions, an alert (i.e., an indication of lane merging after a predetermined distance) can be displayed. As a result, the traffic lanes merging 204 can occur. Therefore, a set of electronic signboards, visuals and/or speech strings can be displayed for alerting the users of impending changes. The alert can also include an electronic output to provide a detailed action sequence and timing/condition sequence for transforming one partition layout into another partition layout, on each given road stretch (i.e., a road message "lanes merging left").

In step 106, a feedback can be accepted to determine an effectiveness of the topology of the lane distributions and the partitions. That is, the pragmatic factors can be updated based on an external policy and external constraints input by a user. In other words, a policy engine can be implemented that allows humans to enter external policies and constraints that the system in turn would respect, such as minimum time duration that a topology necessarily needs to be sustained.

In some embodiments, the new lane distribution of the road stretch can be calculated using Markov Decision Processes (MDP). For example, a policy for the MDP can include a set of <State: Action>. The inputs include the state as a difference in traffic volume along two directions as a result of a change of the partitions (i.e., ameliorating traffic conditions by modifying layout of lanes). Possible input states can include "S1: None" (i.e., a same volume in both directions), "S2: Up-more" (i.e., more traffic in first direction), "S3: Up-All" (i.e., no traffic in a first direction), "S4: Down-more" (i.e., more traffic in a second direction), "S5: Down-All" (i.e., no traffic in a second direction) and the action inputs can include "No change", "Add-Up", "Remove-Up", "Add-Down", "Remove-Down", "Close-Up", and "Close-Down". The MDP can use a reward function for a probability of state transition and discount function can be static or adjusted on a periodic (e.g., daily basis). And, the output can include <S1, No-change>, <S2, Remove-Down>, <S3, Close-Down>, <S4, Remove-Up>, <S5, Close-Up>.

A utility function can be defined and the MDP can solve the utility function automatically, or the MDP can solve in combination with a human review (hybrid). For example, solver may tell which side to reduce/add and a human may decide the exact lane. This can allow for human input as well as faster solving time to increase traffic flow.

It is noted that the symbols are assigned to each lane and partitions in step 102 for ease of the MDP calculation, output control of the partitions, assigning locations for the alerts, etc.

In one example of the invention, a road stretch includes two partitions, B for northbound traffic which is three lanes wide (i.e., L11, L21, L31), and A for south-bound traffic which is also three lanes wide (i.e., L12, L22, L32). However, around 2 pm, being a working day, the children's school that is in the middle of the road stretch ends and cars start arriving to pick the children up, and the school is on the southbound side (i.e., a pragmatic factor). Sensing a lot of cars going south, the northbound partition B goes a lane narrower to two lanes (i.e., L12, L22), and thus A becomes four lanes (i.e., L11, L21, L31, and L41). Thus, a policy has been set to divide the southbound partition into two, during the school ending hours, for 400 meters (e.g., 200 meters in each direction of the school). Therefore, there are two partitions for southbound traffic. Note that, some distance (e.g., 100 meters) before the actual change of partition widths, there would be a notification that lanes are converging, in the form of a message on an electronic board (i.e., an alert). Further, a few minutes (e.g., 5 minutes) before the road partition changes, a notice would appear and stay on an electronic sign board, alerting users not to use the lanes "ahead" as they are going to change. At the point of change, a barrier will also be set up crossroad (e.g., perpendicular to the traffic direction), so that there is no accidental moving of northbound traffic into the southbound lane or vice versa.

Thus, the embodiments herein can provide a method 100 that can dynamically change a number of partitions, as well as a width of each partition of each stretch of a road, where an input to the method are various pragmatic factors such as day, time of the day, day of the month, current traffic conditions, expected traffic conditions based upon historical profiles as well as based upon "today's observations" etc. Also, the steps can provide a method to dynamically update the electronic symbols displayed, that would comply with the next road settings, a method to generate a detailed action sequence and timing/condition sequence, for transforming one partition layout into another partition layout, on each given road stretch, for the administration, a method to display and/or speak out such impending changes to the users (e.g., drivers, pedestrians, etc.) temporally and spatially (location-wise) before they are made/encountered so that the users are notified early enough in the journey, a method to set "horizontal barriers" so that northbound traffic cannot accidentally go into "southbound lanes" or vice versa, and a method to dynamically split and merge stretches of roads (in terms of matching number and width of partitions), subject to the constraint of having sufficient number of electronic notification boards placed on the road for user consumption. Also, the method 100 can interface with a policy engine that would let humans enter external policies and constraints that the system in turn would respect, such as minimum time duration that a topology necessarily needs to be sustained.

Exemplary Aspects, Using a Cloud Computing Environment

Although this detailed description includes an exemplary embodiment of the present invention in a cloud computing environment, it is to be understood that implementation of the teachings recited herein are not limited to such a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as Follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as Follows:

Software as a Service (SaaS): the capability provided to the consumer is to use the provider's applications running on a cloud infrastructure. The applications are accessible from various client circuits through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as Follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Referring now to FIG. 3, a schematic of an example of a cloud computing node is shown. Cloud computing node 10 is only one example of a suitable node and is not intended to suggest any limitation as to the scope of use or functionality of embodiments of the invention described herein. Regardless, cloud computing node 10 is capable of being implemented and/or performing any of the functionality set forth herein.

Although cloud computing node 10 is depicted as a computer system/server 12, it is understood to be operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop circuits, multiprocessor systems, microprocessor-based systems, set top boxes, programmable consumer electronics, network PCs, minicomputer systems, mainframe computer systems, and distributed cloud computing environments that include any of the above systems or circuits, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing circuits that are linked through a communications network. In a distributed cloud computing environment, program modules may be located in both local and remote computer system storage media including memory storage circuits.

Referring now to FIG. 3, a computer system/server 12 is shown in the form of a general-purpose computing circuit. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further described below, memory 28 may include a computer program product storing one or program modules 42 comprising computer readable instructions configured to carry out one or more features of the present invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may be adapted for implementation in a networking environment. In some embodiments, program modules 42 are adapted to generally carry out one or more functions and/or methodologies of the present invention.

Computer system/server 12 may also communicate with one or more external devices 14 such as a keyboard, a pointing circuit, other peripherals, such as display 24, etc., and one or more components that facilitate interaction with computer system/server 12. Such communication can occur via Input/Output (I/O) interface 22, and/or any circuits (e.g., network card, modem, etc.) that enable computer system/server 12 to communicate with one or more other computing circuits. For example, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, circuit drivers, redundant processing units, external disk drive arrays, RAID systems, tape drives, and data archival storage systems, etc.

Figure 4:
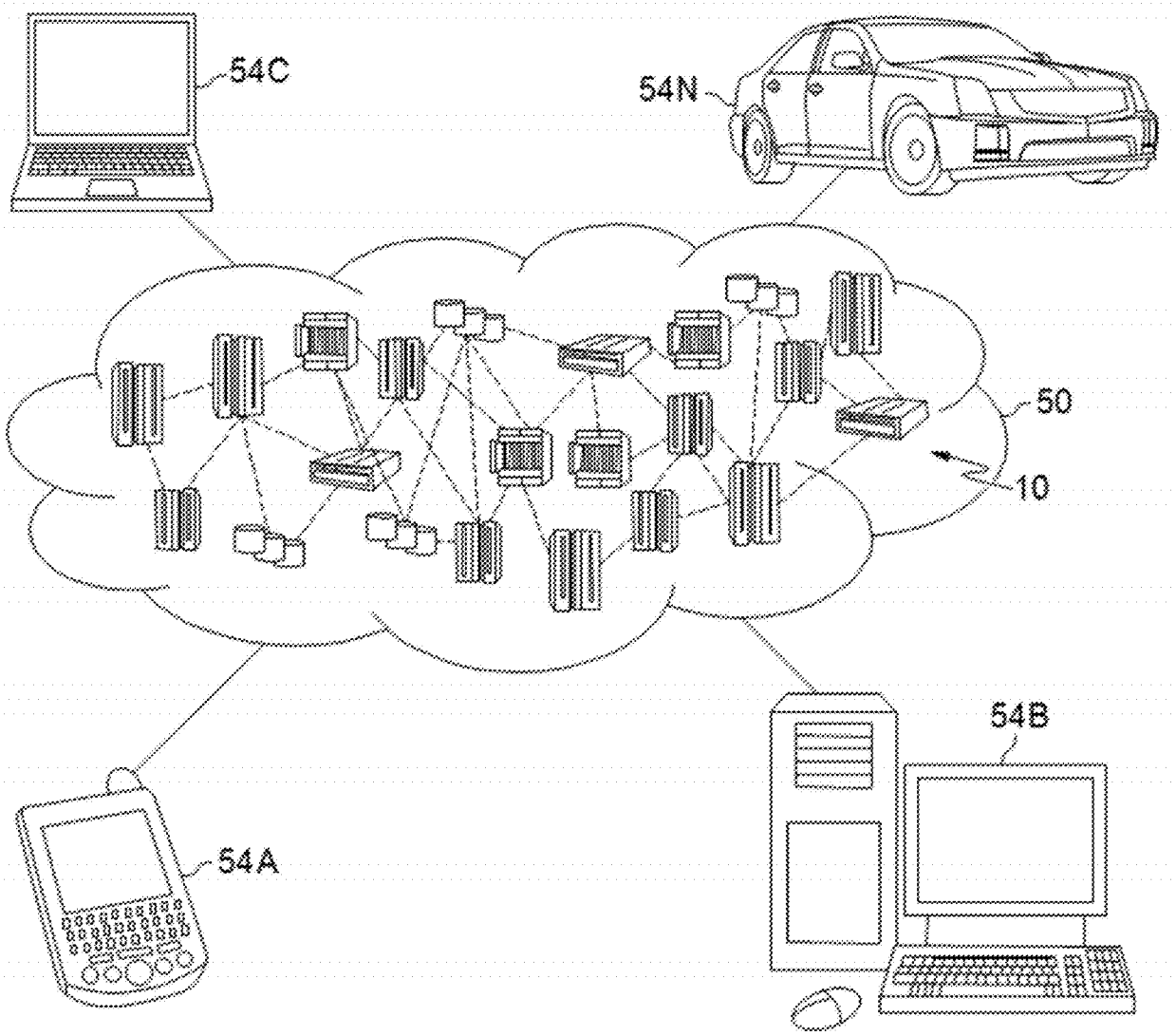
FIG. 4 depicts a cloud-computing environment 50 according to an embodiment of the present invention.

Referring now to FIG. 4, illustrative cloud computing environment 50 is depicted. As shown, cloud computing environment 50 comprises one or more cloud computing nodes 10 with which local computing circuits used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing circuit. It is understood that the types of computing circuits 54A-N shown in FIG. 4 are intended to be illustrative only and that computing nodes 10 and cloud computing environment 50 can communicate with any type of computerized circuit over any type of network and/or network addressable connection (e.g., using a web browser).

Figure 5:
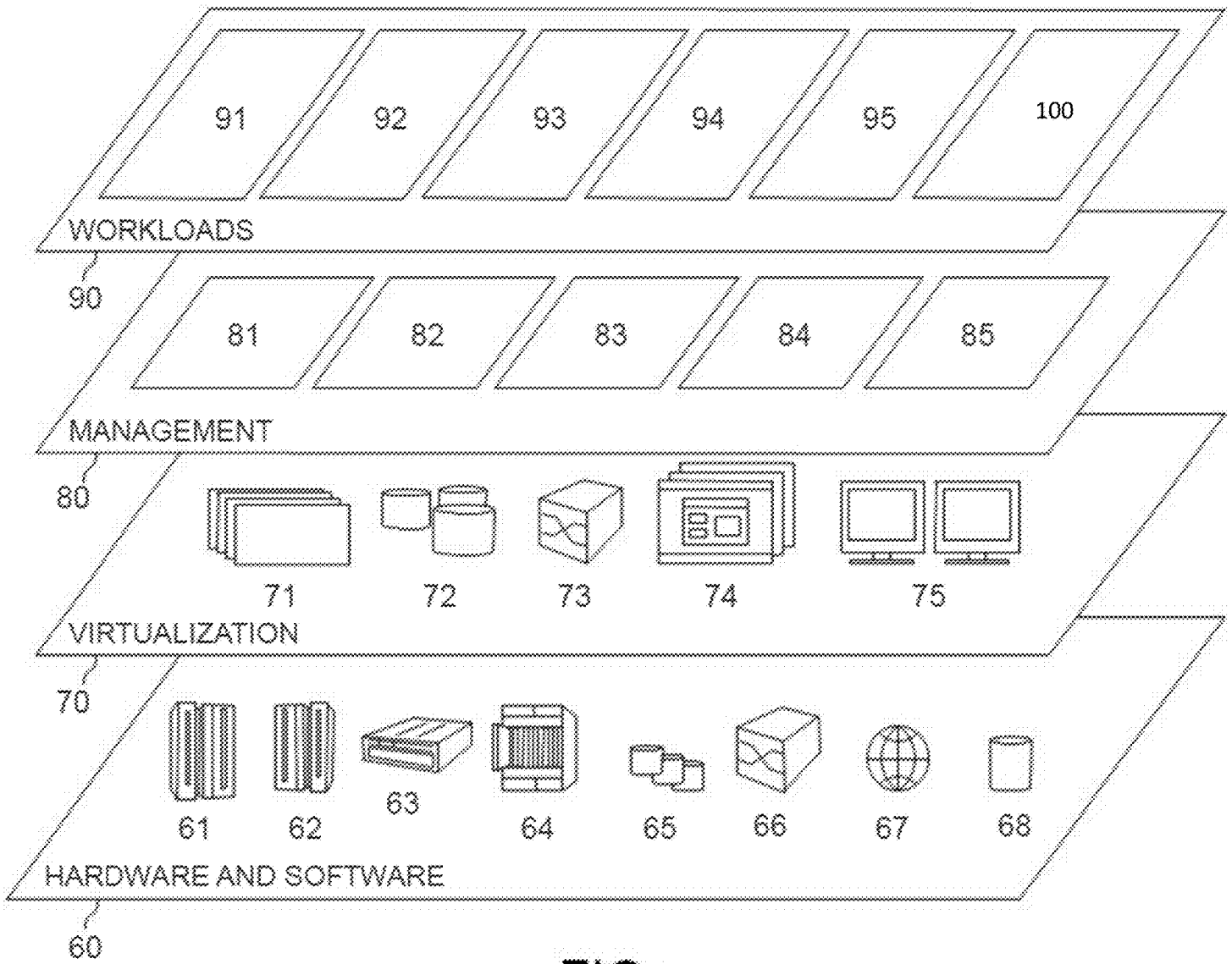
FIG. 5 depicts abstraction model layers according to an embodiment of the present invention.

Referring now to FIG. 5, an exemplary set of functional abstraction layers provided by cloud computing environment 50 (FIG. 4) is shown. It should be understood in advance that the components, layers, and functions shown in FIG. 5 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage circuits 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and road stretch dividing method 100 in accordance with the present invention.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Further, Applicant's intent is to encompass the equivalents of all claim elements, and no amendment to any claim of the present application should be construed as a disclaimer of any interest in or right to an equivalent of any element or feature of the amended claim.

What is claimed is:

1. A computer-implemented dynamic road stretch dividing method, the method comprising:

determining a current lane distribution of partitions of a road stretch;

calculating, using a Markov Decision Process (MDP), a new lane distribution of the road stretch to ameliorate traffic based on a pragmatic factor;

confirming a resultant of the calculation for a policy of the MDP via a human review;

changing an alignment of the partitions of the current lane distribution to obtain the new lane distribution; and updating the pragmatic factor based on at least one of an external policy and a constraint input by a user, wherein the traffic flows in a first direction and a second direction simultaneously while being prevented from crossing over into and entering from the one lane to the second lane or the second lane to the first lane by the partitions, and wherein the policy of the MDP includes a state input of a difference in traffic volume along two directions as a result of a change of the partitions.

2. A computer program product for dynamic road stretch dividing, the computer program product comprising a non-transitory computer-readable storage medium having program instructions embodied therewith, the program instructions executable by a computer to cause the computer to perform:

determining a current lane distribution of partitions of a road stretch;

calculating, using a Markov Decision Process (MDP), a new lane distribution of the road stretch to ameliorate traffic based on a pragmatic factor;

confirming a resultant of the calculation for a policy of the MDP via a human review;

changing an alignment of the partitions of the current lane distribution to obtain the new lane distribution; and updating the pragmatic factor based on at least one of an external policy and a constraint input by a user, wherein the traffic flows in a first direction and a second direction simultaneously while being prevented from crossing over into and entering from the one lane to the second lane or the second lane to the first lane by the partitions, and wherein the policy of the MDP includes a state input of a difference in traffic volume along two directions as a result of a change of the partitions.

3. A dynamic road stretch dividing system, said system comprising:

a processor; and a memory, the memory storing instructions to cause the processor to perform:

determining a current lane distribution of partitions of a road stretch;

calculating, using a Markov Decision Process (MDP), a new lane distribution of the road stretch to ameliorate traffic based on a pragmatic factor;

confirming a resultant of the calculation for a policy of the MDP via a human review;

changing an alignment of the partitions of the current lane distribution to obtain the new lane distribution; and updating the pragmatic factor based on at least one of an external policy and a constraint input by a user, wherein the traffic flows in a first direction and a second direction simultaneously while being prevented from crossing over into and entering from the one lane to the second lane or the second lane to the first lane by the partitions, and wherein the policy of the MDP includes a state input of a difference in traffic volume along two directions as a result of a change of the partitions.

4. The computer-implemented method of claim 1, further comprising:

assigning a symbol for each lane in the current lane distribution of the partitions of the road stretch;

displaying an alert at a predetermined distance in advance of the new lane distribution to update traffic of the upcoming new lane distribution when a symbol for a lane in the current lane distribution does not match a symbol for the lane in the new lane distribution; and sending an alert to a driver.

5. The computer-implemented method of claim 1, wherein the new lane distribution includes a variation of a width of the lanes in the new lane distribution.

6. The computer-implemented method of claim 1, wherein the new lane distribution and the current lane distribution include a same number of total lanes, and wherein the alignment of each lane in a partition of the partitions in the new lane distribution changes a number of lanes in the partition from the current lane distribution.

7. The computer-implemented method of claim 1, wherein a total number of lanes in the new lane distribution equals a total number of lanes in the current lane distribution, and wherein a total number of lanes in each partition of the partitions of the new lane distribution is different from a total number of lanes in each partition of the partitions of the current lane distribution.

8. The computer-implemented method of claim 1, wherein the pragmatic factor is selected from a group consisting of:

a day;

a time of the day;

a day of the month;

a current traffic condition;

an expected traffic conditions based upon historical profiles;

emergency vehicle data;

a current weather;

an expected weather;

a High-Occupancy-Vehicle (HOV) lane data; and accident data.

9. The computer-implemented method of claim 1, embodied in a cloud-computing environment.

* * * * *